US007803259B2

(12) United States Patent
Gestermann et al.

(10) Patent No.: US 7,803,259 B2
(45) Date of Patent: Sep. 28, 2010

(54) ELECTROCHEMICAL CELL

(75) Inventors: Fritz Gestermann, Leverkusen (DE); Hans-Dieter Pinter, Wermelskirchen (DE); Rainer Weber, Odenthal (DE); Gerd Speer, Burscheid (DE); Andreas Bulan, Langenfeld (DE)

(73) Assignee: Bayer MaterialScience AG, Leverkusen (DE)

( * ) Notice: Subject to any disclaimer, the term of this patent is extended or adjusted under 35 U.S.C. 154(b) by 102 days.

(21) Appl. No.: 10/566,066

(22) PCT Filed: Jul. 19, 2004

(86) PCT No.: PCT/EP2004/008038

§ 371 (c)(1),
(2), (4) Date: Jun. 29, 2006

(87) PCT Pub. No.: WO2005/012596

PCT Pub. Date: Feb. 10, 2005

(65) Prior Publication Data

US 2006/0249380 A1 Nov. 9, 2006

(30) Foreign Application Priority Data

Jul. 30, 2003 (DE) ..... 103 35 184

(51) Int. Cl.
*C25B 9/10* (2006.01)

(52) U.S. Cl. ..... 204/252; 204/263; 204/265; 204/266

(58) Field of Classification Search ..... 204/252, 204/263, 265, 266
See application file for complete search history.

(56) References Cited

U.S. PATENT DOCUMENTS 4,242,184 A * 12/1980 Ford ..... 205/345
4,526,663 A * 7/1985 Yoshida et al. ..... 205/525
4,872,958 A * 10/1989 Suzuki et al. ..... 205/521
4,954,388 A 9/1990 Mallouk et al.
5,766,429 A * 6/1998 Shimamune et al. ..... 204/257
6,042,702 A * 3/2000 Kolouch et al. ..... 204/252
6,059,943 A * 5/2000 Murphy et al. ..... 204/296

FOREIGN PATENT DOCUMENTS

EP 0 785 294 7/1997

OTHER PUBLICATIONS

Takenaka, et al., "Studies on Solid Polymer Electrolyte in Water Electrolysis I. Some Properties of Nafion® Ion Exchange Membranes as a Solid Polymer Electrolyte," *Denki Kagaku oyobi Kogyo Butsuri Kagaku* (1984), vol. 52, No. 6, pp. 351-357.
Sudoh, et al., "Evaluation of proton exchange membrane reinforced with fluoroplastic fiber sheet for fuel cell," *Sen'i Gakkaishi* (2004), vol. 60, No. 2, pp. 39-43.
Jung, et al., "Supported Nafion membrane for direct methanol fuel cell," *Journal of Fuel Cell Science and Technology* (2007), vol. 4, No. 3, pp. 248-254.
Rodgers, et al., "The effect of spatial confinement of Nafion in porous membranes on macroscopic properties of the membrane," *Journal of Membrane Science* (2008), vol. 321, No. 1, pp. 100-113.

* cited by examiner

*Primary Examiner*—Bruce F Bell
(74) *Attorney, Agent, or Firm*—Connolly Bove Lodge & Hutz LLP

(57) ABSTRACT

The invention describes an electrochemical cell for the electrolysis of an aqueous solution of hydrogen chloride, comprising at least an anode half-cell with an anode, a cathode half-cell with a gas diffusion electrode as cathode and an ion exchange membrane arranged between the anode half-cell and the cathode half-cell, the membrane consisting of at least a perfluorosulfonic acid polymer, wherein the gas diffusion electrode and the ion exchange membrane are adjacent to each other, characterised in that the gas diffusion electrode and the ion exchange membrane, under a pressure of 250 g/cm$^2$ and at a temperature of 60° C., have a contact area of at least 50%, with respect to the geometric area.

13 Claims, No Drawings

ELECTROCHEMICAL CELL

The invention provides an electrochemical cell with a gas diffusion electrode as cathode and which is particularly suitable for the electrolysis of an aqueous solution of hydrogen chloride.

BACKGROUND OF THE INVENTION

A process for the electrolysis of an aqueous solution of hydrogen chloride is disclosed e.g. in U.S. Pat. No. 5,770,035. An anode compartment with a suitable anode, comprising e.g. a substrate of a titanium/palladium alloy which is coated with a mixed oxide of ruthenium, iridium and titanium, is filled with the aqueous solution of hydrogen chloride. The chlorine formed at the anode escapes from the anode compartment and is fed to a suitable recovery process. The anode compartment is separated from the cathode compartment by a commercially available cation exchange membrane. On the cathode side, a gas diffusion electrode is mounted on the cation exchange membrane. The gas diffusion electrode in its turn is mounted on a current distributor. Gas diffusion electrodes are, for example, oxygen depletion cathodes (ODC). When using an ODC as a gas diffusion electrode, air, oxygen-enriched air or pure oxygen is normally introduced into the cathode compartment and this is reduced on the ODC.

Commercially available ion exchange membranes have a flat support structure of a woven fabric, gauze, braiding or the like made from e.g. polytetrafluoroethylene (PTFE), to one face of which is applied a perfluorosulfonic acid polymer such as e.g. Nafion®, a commercial product from DuPont. If this type of ion exchange membrane is used in an electrolysis cell with a gas diffusion electrode as an oxygen depletion cathode for the electrolysis of an aqueous solution of hydrogen chloride, a relatively high operating voltage, in the region of 1.25 to 1.3 V at 5 kA/m$^2$, is required.

SUMMARY OF THE INVENTION

Therefore the object of the present invention is to provide a membrane electrolysis cell with a gas diffusion electrode as cathode, in particular for the electrolysis of an aqueous solution of hydrogen chloride, which has the lowest possible operating voltage.

DETAILED DESCRIPTION OF THE PREFERRED EMBODIMENTS

The invention provides an electrochemical cell for the electrolysis of an aqueous solution of hydrogen chloride, comprising at least an anode half-cell with an anode, a cathode half-cell with a gas diffusion electrode as cathode and an ion exchange membrane arranged between the anode half-cell and the cathode half-cell, the membrane consisting of at least a perfluorosulfonic acid polymer, wherein the gas diffusion electrode and the ion exchange membrane are adjacent to each other, characterised in that the surface of the gas diffusion electrode facing the ion exchange membrane and the surface of the ion exchange membrane facing the gas diffusion electrode are smooth.

The invention also provides an electrochemical cell for the electrolysis of an aqueous solution of hydrogen chloride, comprising at least an anode half-cell with an anode, a cathode half-cell with a gas diffusion electrode as cathode and an ion exchange membrane arranged between the anode half-cell and the cathode half-cell, the membrane consisting of at least a perfluorosulfonic acid polymer, wherein the gas diffusion electrode and the ion exchange membrane are adjacent to each other, characterised in that the gas diffusion electrode and the ion exchange membrane, under a pressure of 250 g/cm$^2$ and at a temperature of 60° C., have a contact area of at least 50%, preferably at least 70%, with respect to the geometric area.

The contact area according to the invention, between the gas diffusion electrode and the ion exchange membrane under a pressure of 250 g/cm$^2$ and at a temperature of 60° C., can be determined, for example, as described in example 5. The trial in accordance with example 5 simulates the pressure and temperature conditions in the electrochemical cell according to the invention when operating.

The ion exchange membrane consists of at least one layer of a perfluorosulfonic acid polymer such as e.g. Nafion®. Other perfluorosulfonic acid polymers that can be used for the electrolysis cell according to the invention are described e.g. in EP-A 1 292 634. The ion exchange membrane may also have a support or contain included microfibres for mechanical reinforcement.

The support for the ion exchange membrane is preferably a gauze, woven fabric, braiding, knitted fabric, non-woven or foam made of an elastically or plastically deformable material, particularly preferably metal, plastics, carbon and/or glass fibres. PTFE, PVC or PVC-HT are particularly suitable as plastics materials.

In a preferred embodiment of the ion exchange membrane, the support is embedded in one layer or between at least two layers of perfluorosulfonic acid polymer. The ion exchange membrane is particularly preferably built up from at least two layers of the perfluorosulfonic acid, wherein the support for the ion exchange membrane is embedded between the layers or in one of the two layers of perfluorosulfonic acid polymer. This can take place, for example, by applying at least one layer of a perfluorosulfonic acid polymer to each of the two faces of the support. If the support is embedded in one layer or between at least two layers of the perfluorosulfonic acid polymer, the ion exchange membrane has a smoother surface than an ion exchange membrane in which only one face of the support has a layer of a perfluorosulfonic acid. A smoother surface for the ion exchange membrane enables better contact with the gas diffusion electrode. The smoother the surface of the ion exchange membrane, the greater is the area over which the ion exchange membrane makes contact with the adjacent gas diffusion electrode.

The gas diffusion electrode includes an electrically conducting support, preferably made of a woven fabric, braiding, gauze or non-woven made of carbon, metal or sintered metal. The metal or sintered metal must be resistant to hydrochloric acid. These include e.g. titanium, hafnium, zirconium, niobium, tantalum and some Hastalloy alloys. The electrically conducting support is optionally provided with a coating material which contains an acetylene black/polytetrafluoroethylene mixture. This coating material can be applied to the electrically conductive support by spreading with a knife and is then sintered at temperatures of about 340° C. This coating material acts as a gas diffusion layer. The gas diffusion layer can be applied to the entire surface area of the electrically conductive support. It may also be embedded into all or part of the open-pored structure of the support, i.e. a woven fabric, braiding, gauze or the like. An electrically conducting support made of a carbon non-woven which is provided with a gas diffusion layer of an acetylene black/polytetrafluoroethylene mixture is commercially obtainable, for example from the SGL Carbon Group.

The gas diffusion electrode also contains a catalyst-containing layer, also called a catalyst layer. The following may be used as a catalyst for the gas diffusion electrode: noble metals e.g. Pt, Rh, Ir, Re, Pd, noble metal alloys, e.g. Pt-Ru, noble metal-containing compounds e.g. noble metal-containing sulfides and oxides, and chevrel phases e.g. $Mo_4Ru_2Se_8$ or $Mo_4Ru_2S_8$, wherein these may also contain Pt, Rh, Re, Pd, etc.

A gas diffusion electrode suitable for use in the electrolysis cell according to the invention and the production thereof is disclosed in e.g. WO 04/032263 A. Electrical contact with the gas diffusion electrode is achieved via a current distributor, on which the gas diffusion electrode lies.

In the electrochemical cell according to the invention, the entire areas of the ion exchange membrane and the gas diffusion electrode which acts as a cathode when the cell is operating are adjacent, wherein the ion exchange membrane and the gas diffusion electrode, under a pressure of 250 g/cm$^2$ and at a temperature of 60° C., have a contact area of at least 50%. In general, an electrochemical cell of the type according to the invention is operated under a pressure of 0.2 to 0.5 kg/m$^2$ and at a temperature of 40 to 65° C. The smoothest possible surface is also desirable for the gas diffusion electrode because the smoothest possible surface improves contact with the ion exchange membrane. In order to produce the smoothest possible surface, the gas diffusion layer and/or the catalyst layer can be applied, for example, by means of a spray process, wherein the drops of sprayed dispersion must flow as uniformly as possible. A suitable spray process is disclosed e.g. in WO 04/032263 A. An open-pore, electrically conducting support in which the pores are closed by the gas diffusion layer is preferably used. The gas diffusion layer and/or the catalyst layer can also be applied by a machine using rollers or brushes.

The greatest possible contact area is produced by appropriate choice of the gas diffusion electrode and ion exchange membrane. Both of these must have the smoothest possible surface and at the same time the best possible microdeformability, i.e. good deformability in the micron range.

In a special embodiment of the electrolysis cell according to the invention, the catalyst layer for the gas diffusion electrode is applied to the ion exchange membrane. The catalyst layer can be applied to the ion exchange membrane, for example, by spraying on or by means of a film casting process disclosed in the prior art. In this way the ion exchange membrane and the catalyst layer form a membrane electrode unit (MEU). In this case, the electrically conducting support with the gas diffusion layer is adjacent to the catalyst layer. Here, the contact area according to the invention of at least 50%, preferably at least 70%, with respect to the geometric area, under a pressure of 250 g/cm$^2$ and at a temperature of 60° C., is between the gas diffusion layer and the catalyst layer of the MEU.

The electrolysis cell according to the invention has a 100 to 300 mV lower operating voltage during the electrolysis of an aqueous solution of hydrogen chloride (hydrochloric acid).

In a preferred embodiment, the ion exchange membrane is built up from at least two layers, wherein the layers have different equivalent weights. The equivalent weight, in the context of the invention, is understood to be the amount of perfluorosulfonic acid polymer which is required to neutralise 1 liter of 1 N caustic soda solution. The equivalent weight is thus a measure of the concentration of the ion-exchanging sulfonic acid groups. The equivalent weight of the ion exchange membrane is preferably 600 to 2500, in particular 900 to 2000.

If the ion exchange membrane is built up from several layers with different equivalent weights, then, in principle, the layers may be arranged in any way at all with respect to each other. However, an ion exchange membrane is preferred in which the layer of ion exchange membrane which faces the gas diffusion electrode, i.e. is adjacent to the gas diffusion electrode, has a higher equivalent weight than the other layers. If, for example, the ion exchange membrane is built up from two layers, then the equivalent weight of the layer facing the anode is 600 to 1100 and the equivalent weight of the layer facing the gas diffusion electrode is 1400 to 2500. If more than two layers are present, then the equivalent weight can increase from the layer facing the anode in the direction towards the layer facing the gas diffusion electrode. However, it is also possible to arrange layers with higher and lower equivalent weights in an alternating manner, wherein the layer adjacent to the gas diffusion electrode has the highest equivalent weight.

Chlorine transport through the ion exchange membrane can be reduced by choosing the equivalent weight and by choosing layers with different equivalent weights. The smallest possible migration of chlorine through the ion exchange membrane is desirable. In the ideal case, the migration of chlorine should be completely suppressed because chlorine is reduced to chloride in the catalyst layer of the gas diffusion electrode and forms dilute hydrochloric acid with the water of reaction formed in the cathode half-cell. On the one hand this cannot be used again and therefore has to be disposed of. On the other hand contact of dilute hydrochloric acid with the gas diffusion electrode leads to overvoltages and possibly also to corrosive damage to the catalyst present in the gas diffusion electrode.

Furthermore, the transport of water from the anode half-cell through the ion exchange membrane into the cathode half-cell should be reduced to about one third in the electrochemical cell according to the invention. This is also of advantage because less dilute hydrochloric acid, which has to be disposed of, is formed in the cathode half-cell in this way. Another advantage of the small extent of water transport is that there is less risk of forming a film of water on the surface of the gas diffusion electrode. This in turn improves oxygen transport through the gas diffusion electrode.

The anode in the electrochemical cell according to the invention consists of gauze, woven fabric, knitted fabric, braiding, or the like, preferably of an expanded metal of e.g. Pd-stabilised titanium which is provided e.g. with a coating of a Ru-Ti mixed oxide. A suitable anode is disclosed in e.g. WO 03/056065 A.

EXAMPLES

Example 1

Gas diffusion electrodes like those disclosed in U.S. Pat. No. 6,402,930 and U.S. Pat. No. 6,149,782 were tested with a proton-conducting ion exchange membrane of the perfluorosulfonic acid type supplied by Fumatech, with an equivalent weight of 950, in a laboratory test using a laboratory cell which had an electrochemically active area of 100 cm$^2$.

The ion exchange membrane had an internally located support fabric of glass fibres as a support, i.e. the support was embedded in the perfluorosulfonic acid polymer. The ion exchange membrane used is described in EP-A 129 26 34.

The gas diffusion electrode had the following structure: an electrically conductive layer of carbon fabric was provided with a gas diffusion layer comprising an acetylene black/polytetrafluoroethylene mixture. A catalyst layer comprising a catalyst/polytetrafluoroethylene mixture was applied to this support provided with the gas diffusion layer. The rhodium sulfide catalyst was adsorbed on carbon black (Vulcan® XC72). Since the gas diffusion electrode was operated in direct contact with an ion exchange membrane, it was also provided with a layer of Nafion®, a proton-conducting ionomer, in order to produce better linkage to the ion exchange membrane. The surface of the oxygen depletion cathode was approximately smooth, apart from typical shrinkage cracks due to the manufacturing process. The oxygen depletion cathodes used are described in U.S. Pat. No. 6,149,782. The current distributor in the oxygen depletion cathode was an expanded titanium metal with a Ti/Ru mixed oxide coating.

A commercially available anode of expanded titanium/palladium metal with a titanium/ruthenium mixed oxide coating was used as the anode. Under the operating conditions of 5 kA/m$^2$, 60° C., 14% technical grade hydrochloric acid and a distance of 3 mm between the anode and the ion exchange membrane pressed onto the cathode under a hydrostatic pressure of 200 mbar, the test cell exhibited an operating voltage of 1.16 V when operated continuously for 16-days.

Example 2 (Comparison Example)

The oxygen depletion cathodes described in example 1 were tested with a proton-conducting ion exchange membrane of the Nafion® 324 type from DuPont under the conditions described in example 1, in several comparison trials.

The oxygen depletion cathodes were from the same production batch as the oxygen depletion cathodes used in example 1.

One face only of the ion exchange membrane was coated with the perfluorosulfonic acid polymer, not both faces, wherein the support was mounted on the oxygen depletion cathode in the form of a supporting fabric. This meant that adequate areal contact between the oxygen depletion cathode and the perfluorosulfonic acid polymer on the ion exchange membrane was not possible. The structure of the support fabric increased the roughness of the surface. Operating voltages of 1.31 to 1.33 were found during the comparison trials.

Example 3

Tests with oxygen depletion cathodes with different surface roughnesses were performed in the arrangement described in example 1 and under the operating conditions defined in example 1.

In a first test, an ion exchange membrane from Fumatech was tested with an oxygen depletion cathode which consisted of a carbon non-woven, filled with a gas diffusion layer (as described in example 1) and sprayed with a catalyst layer comprising 30% rhodium sulfide on carbon black of the Vulcan® XC72 type and Nafion® ionomer solution. The oxygen depletion cathode had a surface roughness of about 140 μm; see example 5. This electrode exhibited a stable operating voltage of 1.28 V.

In a second test, this oxygen depletion cathode was tested with an ion exchange membrane of the Nafion® 324 type from DuPont. A voltage of 1.32 V was found. Thus, this showed that both the smoothness of the membrane and also the smoothness of the oxygen depletion cathode are critical for a large area of contact between the ion exchange membrane and the gas diffusion electrode.

Example 4

Chlorine diffusion through different ion exchange membranes was tested. This is expressed, in combination with the water transport index under the operating conditions, as different hydrochloric acid concentrations in the catholyte. The following membranes were tested under open-circuit conditions in the zero current state:

- Nafion® 117: monolayered with an equivalent weight of 1100; no supporting fabric
- Nafion® 324: two layers with equivalent weights of 1100 and 1500 respectively; with an externally mounted supporting fabric facing the oxygen depletion cathode, i.e. the support was not embedded in the perfluorosulfonic acid polymer.
- Ion exchange membrane from Fumatech, monolayered with an equivalent weight of 950 and an internally located supporting fabric, i.e. the support was embedded in the perfluorosulfonic acid polymer (called Fumatech membrane 950 in the following).

The following behaviour with regard to chlorine diffusion was observed in a 7-hour test:

Nafion® 117: 3511 mg of chlorine

Nafion® 324: 503 mg of chlorine

Fumatech membrane 950: 1144 mg of chlorine

In addition, it was found that, with comparable operation of the three types of membrane, the Nafion® membranes had a water transport index of about 1 (i.e. 1 mol of $H_2O$ per mol of protons through the membrane) under the conditions mentioned in example 1, whereas the Fumatech membrane had a water transport index of only 0.37, i.e. about one third.

It was shown that the monolayered Nafion® 117 membrane and the Fumatech membrane 950 had chlorine diffusions which differed by a factor of more than 3, wherein the advantage lay with the Fumatech membrane, despite the low equivalent weight.

On the other hand, the fact that Nafion® 324 had two layers, in combination with a higher equivalent weight for the layer on the cathode face, resulted in a lowering of the chlorine transport to about 1/7 as compared with Nafion® 117 and to about one half as compared with the Fumatech membrane 950.

In view of the low chlorine diffusion, an ion exchange membrane with a combination of two or more layers with different equivalent weights is preferred, wherein the equivalent weight increases in the direction towards the oxygen depletion cathode. A considerable reduction in chlorine diffusion, optionally down to approximately zero, can be produced in this way. The very low water transport index of the Fumatech membrane, about 1/3 as compared with the Nafion® membranes, enables operation of the oxygen depletion cathode in the moist, i.e. not in the wet, state. Operation in the wet state is known for all Nafion® membranes.

Example 5

The contact area between gas diffusion electrodes (GDE) and ion exchange membranes, while simulating the conditions prevailing in an electrolysis cell, was determined with the aid of the following laboratory trial.

One face of a strip of ion exchange membrane of about 3×7 cm$^2$ was soaked with 30 μl of a fluorescent solution. The fluorescent solution was made up in a glycerine/water mixture. For this purpose, fluorescein powder was dissolved in water and glycerine was added thereto. The water:glycerine ratio was 1:1 (80 mg of fluorescein, 4.7 g of water, 4.7 g of glycerine).

The ion exchange membrane soaked on one face was stretched over a neoprene fine foam cushion so that the soaked face was adjacent to the fine foam cushion. This face, turned towards the fine foam cushion, is also called the lower face in the following. The neoprene foam cushion substrate had a size of 2.2×2.2 $cm^2$.

The upper face of the ion exchange membrane was also wetted with 30 μl of the fluorescent solution. Then the surface was covered with a glass plate and a weight of about 200 g was applied thereto. This distributed the fluorescent solution on the upper and lower faces on the ion exchange membrane uniformly over the two faces.

The ion exchange membrane soaked in this way and applied to a fine foam cushion was stored in a desiccator for 3 hours at 100% humidity and room temperature. The membrane was then thoroughly soaked throughout. After storage in the desiccator, any residual liquid film was removed from the two faces of the ion exchange membrane.

The gas diffusion electrode with an area of 2.2×2.2 $cm^2$ was laid on the ion exchange membrane (the face turned towards the ion exchange membrane is also called the upper face in the following). The current distributor was mounted on the rear face of the gas diffusion electrode, i.e. the face turned away from the ion exchange membrane. The appropriate weight to provide an applied pressure of 250 $g/cm^2$ was placed thereon. This entire structure was stored for 19 h in a dessicator in a drying cabinet at 100% humidity and 60° C.

After storage, the gas diffusion electrode was taken out and fixed on a microscope slide for microscopic assessment.

Assessment using a confocal laser scanning microscope Leica TCS NT:

A general image of the GDE surface was obtained with back-scattering and fluorescence contrast. The image area was 6.250×6.250 $mm^2$. The photomultiplier gain of the back-scattering channel was set at 322 volts for full laser power (about 22 mW, laser output). The photomultiplier voltage for the fluorescence channel was 1000 V. The images were taken in mode 488/>590 nm. Using this setting, the slide was illuminated with the wavelength 488 nm from the $Ar^+$ laser. The back-scattering image was recorded at the same wavelength. The image in the fluorescence channel was drawn up from the fluorescent light from the sample surface which is at wavelengths longer than 590 nm.

The images for assessment were taken with the objective× 10/0.3 air. The image area was then 1.0×1.0 $mm^2$. For statistical reasons, 8 image areas were taken. Since the surface had obvious topographic structures, series of sectional views were taken. With the gas diffusion electrode in accordance with example 1 (carbon tissue electrode) the difference in height to be overcome was about 70 μm, with the carbon non-woven electrode it was about 140 μm. The images were also recorded in mode 488/>590 nm. In the case of the carbon tissue electrode a series of sectional views of 72.9 μm with 63 individual slices was taken each time. The gain at the back-scattering channel was 231 volts, the gain at the fluorescence channel was 672 volts.

In the case of the carbon non-woven electrode a series of sectional views of 143 μm with 127 individual slices was taken each time. The gain at the back-scattering channel was 266 volts, the gain at the fluorescence channel was 672 volts.

A topography image was drawn up from the set of image data from the back-scattering channel. A projection image was produced from the set of image data from the fluorescence channel. On this projection image, only the palest point from the series of sectional views running in the z direction was shown for each xy coordinate. This image was used for further image analysis assessment of the surface coating.

A histogram was plotted in a fixed image frame with an enclosed area of 261632 pixels. The frequencies of each intensity (0-255) occurring was determined from this histogram (see table 1).

Table 1, given below, gives the contact area determined in this way as a %-age, as well as the mean square deviation over 8 measurements for different combinations of ion exchange membranes and gas diffusion electrodes. The following were used as gas diffusion electrodes: carbon tissue electrode in accordance with example 1 (also called type A in the following), carbon non-woven electrode in accordance with example 3, wherein the carbon non-woven had been filled with a gas diffusion layer and sprayed with a rhodium sulfide catalyst layer as well as a Nafion® ionomer solution (also called type B in the following) as well as carbon non-woven electrodes which were coated with an open-pore gas diffusion layer and had been sprayed with a rhodium sulfide catalyst layer and a Nafion® ionomer solution (also called type C in the following). An open-pore coating is understood here to be a coating which does not close the pores in the carbon non-woven or the like. An open-pore coating can be produced, for example, by soaking the support, e.g. the carbon non-woven, whereas in the case of a closed-pore, i.e. filled, coating, the gas diffusion layer is applied, for example, to the support, which fills the pores in the support.

The following commercially available membranes were used as ion exchange membranes: ion exchange membranes of the perfluorosulfonic acid type from Fumatech with an internal, i.e. embedded, support in accordance with example 1 (called Fumatech 950), ion exchange membranes of the perfluorosulfonic acid type from DuPont with an external, i.e. not embedded, support in accordance with example 2 (called Nafion® 324) as well as ion exchange membranes of the perfluorosulfonic acid type from DuPont without a support (called Nafion® 105).

The voltage was measured at 5 $kA/m^2$ and 60° C.

The results in table 1 show that a large contact area between ion exchange membrane and gas diffusion electrode is associated with a lower cell voltage than is a small contact area.

TABLE 1

| Ion exchange membrane | Gas diffusion electrode | Contact area [%] | Mean square deviation | Voltage [V] |
|---|---|---|---|---|
| Fumatech 950 | type A | 76.5 | 2.8 | 1.16 |
| Nafion ® 105 | type A | 74.4 | 2.3 | 1.17 |
| Fumatech 950 | type B | 18.0 | 3.0 | 1.28 |
| Nafion ® 324 | type B | 8.3 | 1.5 | 1.32 |
| Fumatech 950 | type C | 75.3 | 4.1 | 1.22 |
| Nafion ® 324 | type C | 6.5 | 1.6 | 1.31 |

The invention claimed is:

1. An electrochemical cell for electrolysis of an aqueous solution of hydrogen chloride comprising:

a) an anode half-cell comprising an anode, b) a cathode half-cell comprising a gas diffusion electrode as the cathode, and c) an ion exchange membrane comprising a perfluorosulfonic acid polymer which is positioned between a) and b)

wherein the gas diffusion electrode has a surface having a geometric area, and wherein the ion exchange membrane has a surface having a geometric area, the surface of the ion exchange membrane comprising a layer of the perfluorosulfonic acid polymer with a support member embedded therein, and wherein the surface of the gas diffusion electrode and the surface of the ion exchange membrane are adjacent to each other and, at a pressure of 250 g/cm$^2$ and a temperature of 60° C., the gas diffusion electrode and the ion exchange membrane have a contact area of at least 50% of their geometric area.

2. The electrochemical cell of claim 1 in which the contact area of the gas diffusion electrode and ion exchange membrane is at least 70%.

3. The electrochemical cell of claim 2 in which the ion exchange membrane comprises at least two layers of perfluorosulfonic acid polymer and a support member is embedded between the two layers or in at least one of the layers.

4. The electrochemical cell of claim 3 in which the two layers of perfluorosulfonic acid polymer have different equivalent weights.

5. The electrochemical cell of claim 2 in which the perfluorosulfonic acid polymer has an equivalent weight of from 600 to 2500.

6. The electrochemical cell of claim 1 in which the ion exchange membrane comprises at least two layers of perfluorosulfonic acid polymer and a support member is embedded between the two layers or in at least one of the layers.

7. The electrochemical cell of claim 6 in which the two layers of perfluorosulfonic acid polymer have different equivalent weights.

8. The electrochemical cell of claim 6 in which the perfluorosulfonic acid layer with one of its surfaces facing the gas diffusion electrode has a higher equivalent weight than any other perfluorosulfonic acid layer.

9. The electrochemical cell of claim 1 in which the perfluorosulfonic acid polymer has an equivalent weight of from 600 to 2500.

10. The electrochemical cell of claim 1 in which the perfluorosulfonic acid polymer has an equivalent weight of from 900 to 2000.

11. The electrochemical cell of claim 1 in which a catalyst layer for the gas diffusion electrode is applied to the ion exchange membrane.

12. The electrochemical cell of claim 1, wherein the support member comprises gauze, woven fabric, braided fabric, knit fabric, non-woven material, plastic foam or elastically deformable material.

13. The electrochemical cell of claim 1, wherein the support member comprises metal, plastic, carbon fibers or glass fibers.

* * * * *